US005691490A

United States Patent [19]

Williams

[11] Patent Number: 5,691,490

[45] Date of Patent: *Nov. 25, 1997

[54] STRINGED MUSICAL INSTRUMENT WITH KEYBOARD

[76] Inventor: Maschon Williams, 6820 Santa Monica Blvd., Los Angeles, Calif. 90038

[ * ] Notice: The term of this patent shall not extend beyond the expiration date of Pat. No. 5,596,157.

[21] Appl. No.: 784,265

[22] Filed: Jan. 15, 1997

Related U.S. Application Data

[63] Continuation-in-part of Ser. No. 305,600, Dec. 12, 1994, Pat. No. 5,596,157.

[51] Int. Cl.[6] ..... G10D 15/00

[52] U.S. Cl. ..... 84/170; 84/291; 84/267; 84/423 R; 84/263

[58] Field of Search ..... 84/170, 171, 267, 84/291, 423 R, 263

[56] References Cited

U.S. PATENT DOCUMENTS

| | | | |
|---|---|---|---|
| 522,048 | 6/1894 | Duvivier | 84/170 |
| 1,425,032 | 8/1922 | Milito | 84/170 |
| 5,507,215 | 4/1996 | Lin | 84/423 R |
| 5,596,157 | 1/1997 | Williams | 84/170 |

*Primary Examiner*—Cassandra C. Spyrou
*Attorney, Agent, or Firm*—Richard C. Litman

[57] ABSTRACT

A stringed musical instrument such as an electric or acoustic guitar and a bass guitar in combination with a piano-type keyboard. The musical instrument of the present invention includes a body with a neck extending from the body and a plurality of strings extending across the neck and the body. The body has a portion extending outward from the strings upon which the keyboard is adjustably attached using a bracket The present invention provides a user with ready access to both the stringed instrument and the keyboard. The user may utilize the stringed instrument and keyboard separately alternating therebetween or simultaneously having one hand of the user play the keyboard as well striking and/or strumming the strings. The user also has the ability to adjust the positioning of the keyboard in relation to the stringed instrument. The adjustability of the keyboard allows the user to orient the keyboard in the most comfortable position for playing so that the user may excel at performing with the present invention.

19 Claims, 5 Drawing Sheets

STRINGED MUSICAL INSTRUMENT WITH KEYBOARD

CROSS-REFERENCE TO RELATED APPLICATION

This application is a continuation-in-part of application Ser. No. 08/305,600, filed Dec. 12, 1994, U.S. Pat. No. 5,596,137.

BACKGROUND OF THE INVENTION

1. Field of the Invention

The present invention relates to a stringed musical device such as a guitar, bass guitar, or other similar stringed instrument in combination with a conventional piano-type keyboard. The present invention allows the user to play the stringed instrument and the keyboard simultaneously.

2. Description of Prior Art

Combined musical instruments have been the subject of earlier U.S. patents. For instance, U.S. Pat. No. 522,048, issued on Jun. 26, 1894, to Louis Jean Marie Duvivier describes a keyboard for attachment to a viola or cello instrument. The keyboard is connected above the strings to the neck of the instrument. Depressing of the keys of the keyboard causes dampers to press on the strings of the instrument in order to facilitate producing the sound.

U.S. Pat. No. 1,425,032, issued on Aug. 8, 1992, to Peter Milito describes a musical device, such as a guitar, with a series of bells or chimes disposed within the hollow body of the guitar. The bells are in the form of metallic flat bars that are arranged in order of varying length and adapted to be struck by respective hammers actuated by an electric circuit.

The patents to Duvivier and Milito fail to teach or suggest that a keyboard may be attached to an extending portion of a body of a stringed instrument as claimed. They also fail to teach or suggest that a keyboard may be adjustably attached to an extending portion of a body of a stringed instrument as claimed.

None of the above inventions and patents, taken either singularly or in combination, is seen to describe the instant invention as claimed. Thus a stringed musical instrument with keyboard solving the aforementioned problems is desired.

SUMMARY OF THE INVENTION

The present invention relates to a stringed musical instrument such as an electric or acoustic guitar and a bass guitar in combination with a piano-type keyboard. The musical instrument of the present invention includes a body with a neck extending from the body and a plurality of strings extending across the neck and the body. The body has a portion extending outward from the strings upon which the keyboard is adjustably attached using a bracket.

The present invention provides a user with ready access to both the stringed instrument and the keyboard. The user may utilize the stringed instrument and keyboard separately and alternate therebetween or the user may simultaneously play the keyboard and strike and/or strum the strings. The user also has the ability to adjust the positioning of the keyboard in relation to the stringed instrument. The adjustability of the keyboard allows the user to orient the keyboard in the most comfortable position for playing so that the user may excel at performing with the present invention.

Accordingly, it is a principal object of the invention to provide a stringed musical instrument in combination with a keyboard.

It is another object of the invention to provide a stringed-keyboard musical instrument that enables a user to readily play both the stringed and keyboard instruments together with syncopation.

It is a further object of the invention to provide a stringed musical instrument in combination with a keyboard whose position may be adjusted in relation to the stringed instrument in order to optimize the comfort and feel of the instrument for the user.

Still another object of the invention is to provide a stringed musical instrument in combination with an adjustable keyboard which is capable of quick and easy adjustment into a vast number of positions.

It is an object of the invention to provide improved elements and arrangements thereof in a stringed musical instrument with keyboard for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
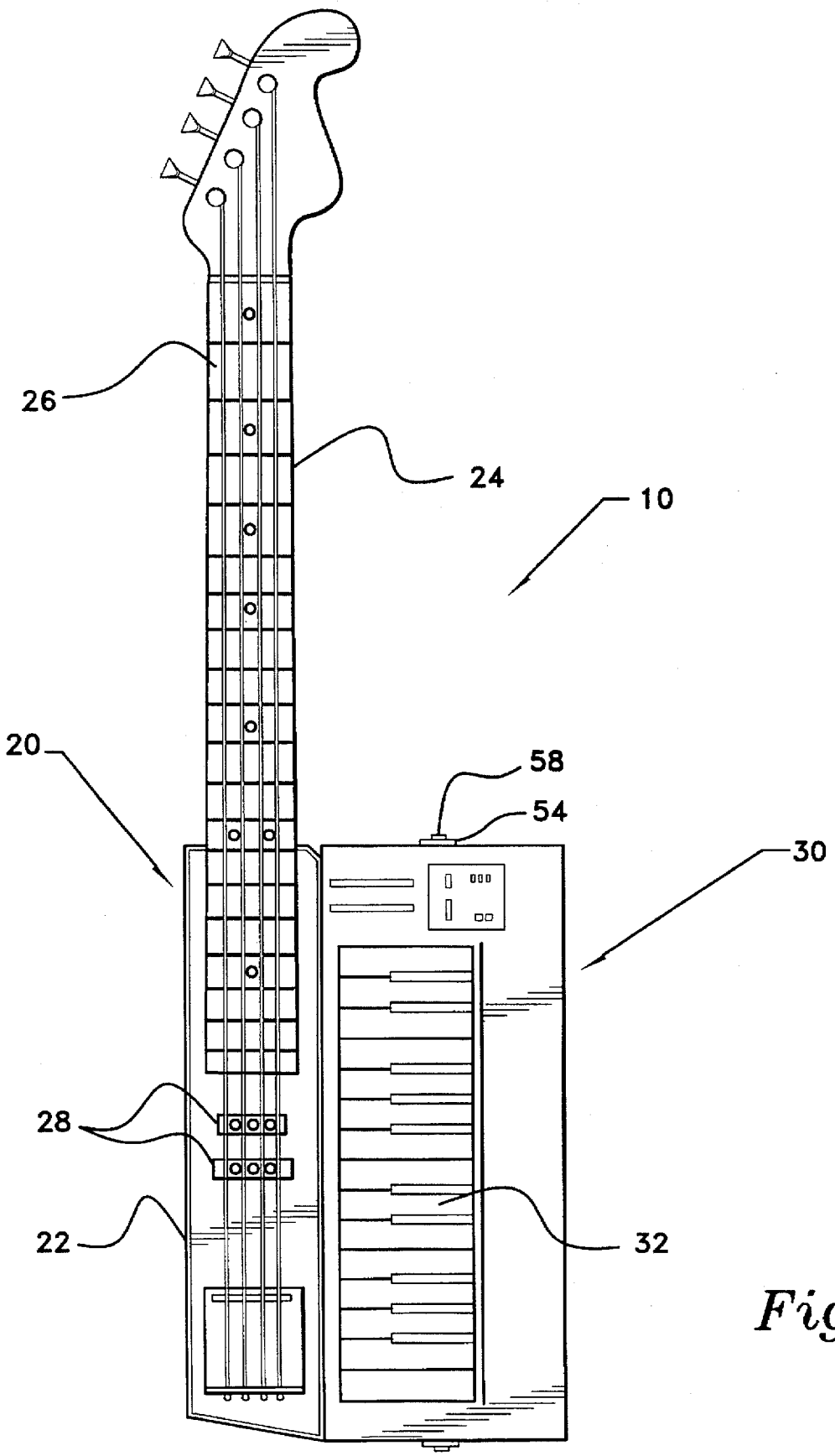
FIG. 1 is a front elevational view of a stringed musical instrument with keyboard according to the present invention.

Referring to FIG. 1, the present invention 10 relates to a stringed musical instrument 20, such as an electric or acoustic guitar, or a bass guitar, or other stringed instrument, in combination with a piano-type keyboard 30. The positional relationship between the keyboard 30 and the strings 26 of the stringed instrument 20 may be quickly and easily adjusted into a vast number of positions in order to optimize the comfort and feel of the instrument 10 for the user.

The stringed instrument 20 includes a body 22 with a neck 24 extending from the body 22 and a plurality of strings 26 extending across the neck 24 and the body 22. The body of the stringed instrument 20 has two conventional electric pick-ups 28 attached thereto for amplification purposes. The body 22 may either be solid or hollow depending on the sound the user wishes to produce. It is contemplated that the present invention may be used with a wide variety of stringed instruments including, but not limited to, bass guitars, acoustical guitars, and all types of electric guitars.

Figure 3:
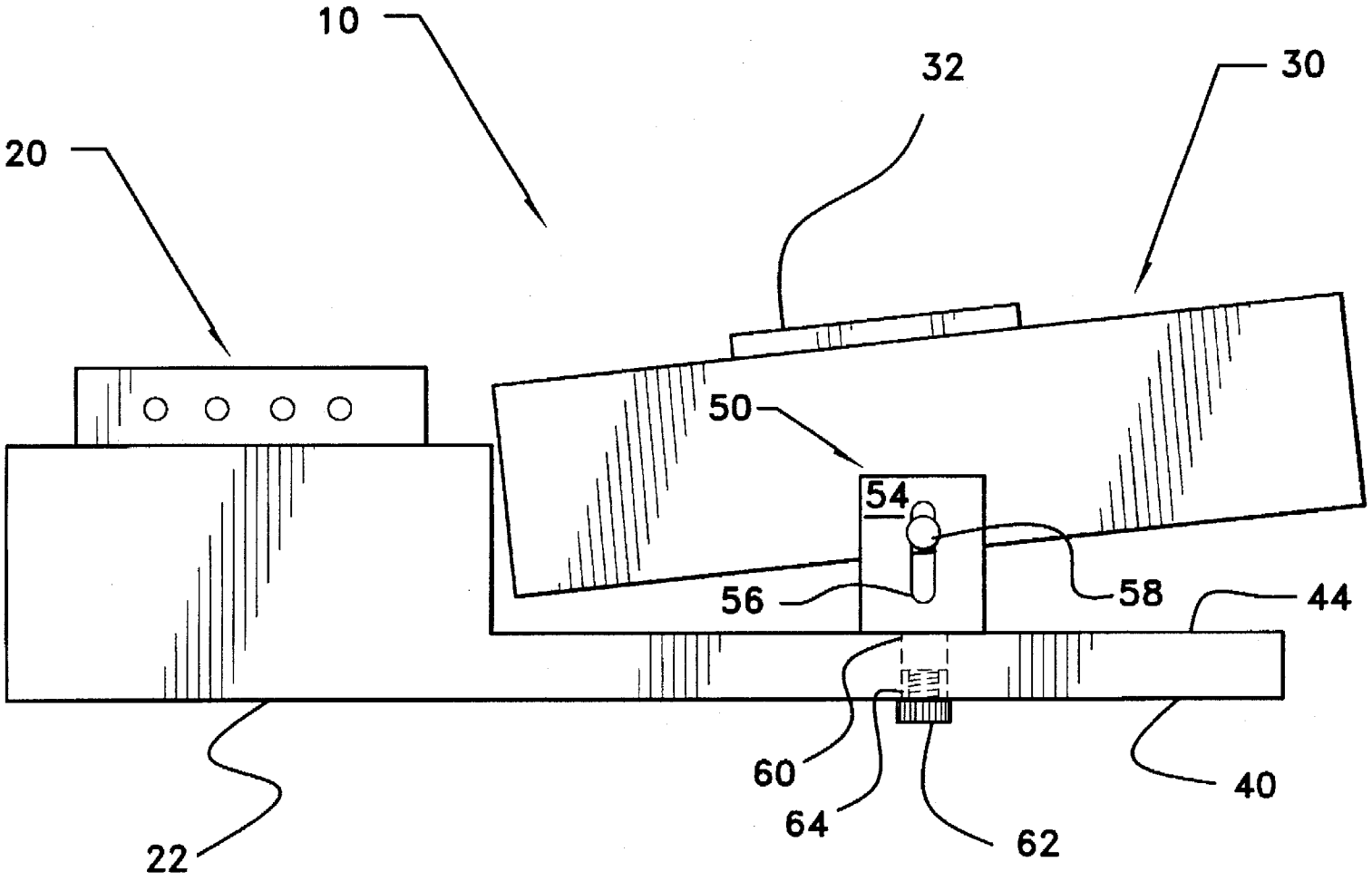
FIG. 3 is an end elevational view of a stringed musical instrument with keyboard showing the bracket holding the keyboard in a slightly elevated and inclined position.

The body 22 has a portion 40 (see FIG. 4) extending outward from the strings 26 upon which the keyboard 30 is adjustably attached using a bracket 50 (see FIG. 3 The keyboard 30 has a plurality of keys 32. Preferably, a two to three octave keyboard 30 is used as part of the present invention.

In operation, a user has ready access to both the stringed instrument 20 and the keyboard 30. The user may utilize the stringed instrument 20 and keyboard 30 separately and alternate therebetween or the user may simultaneously play the keyboard 30 and strike and/or strum the strings 26 of the stringed instrument 20.

Figure 4:
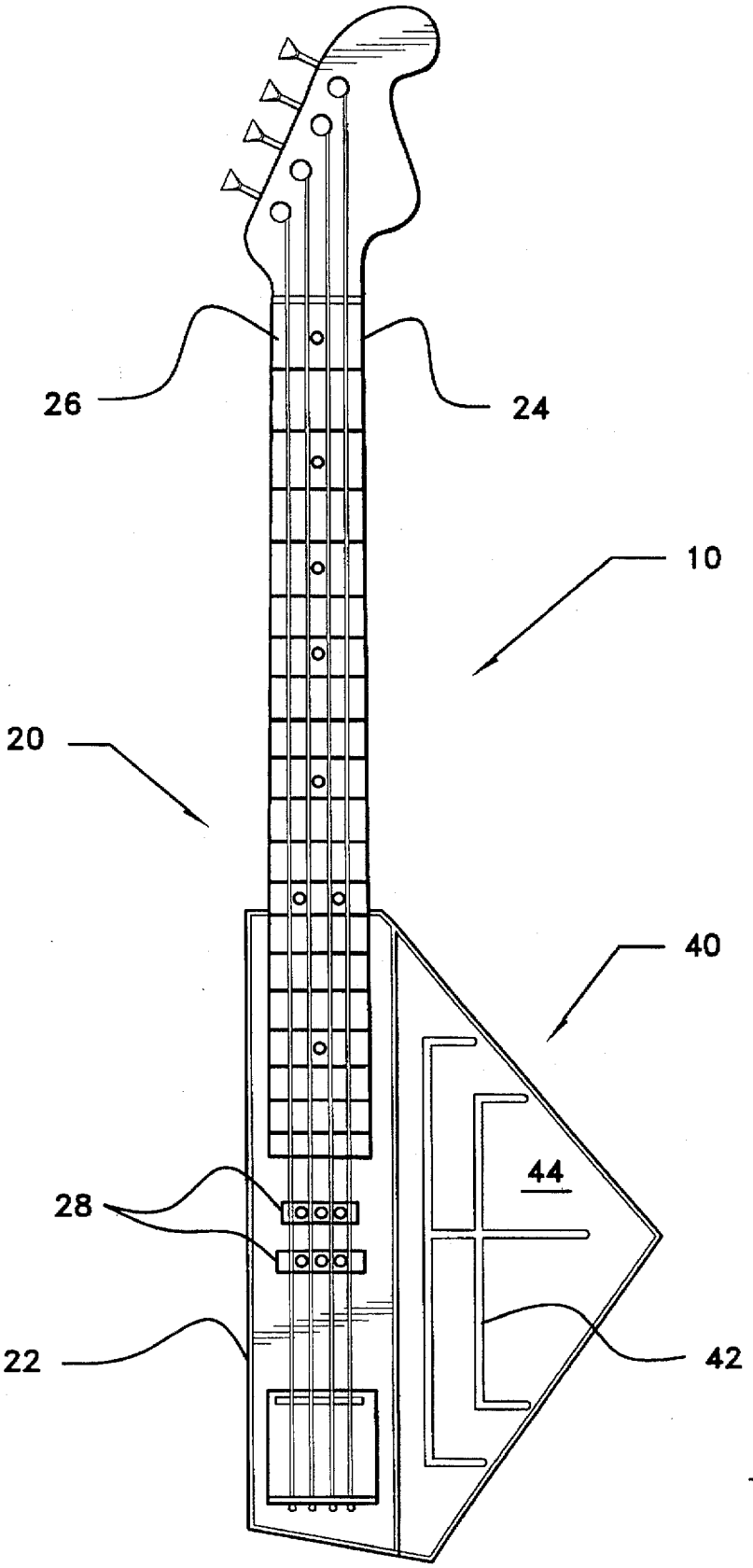
FIG. 4 is a front elevational view of the present invention with the keyboard removed to reveal the adjustment channels.
Figure 5:
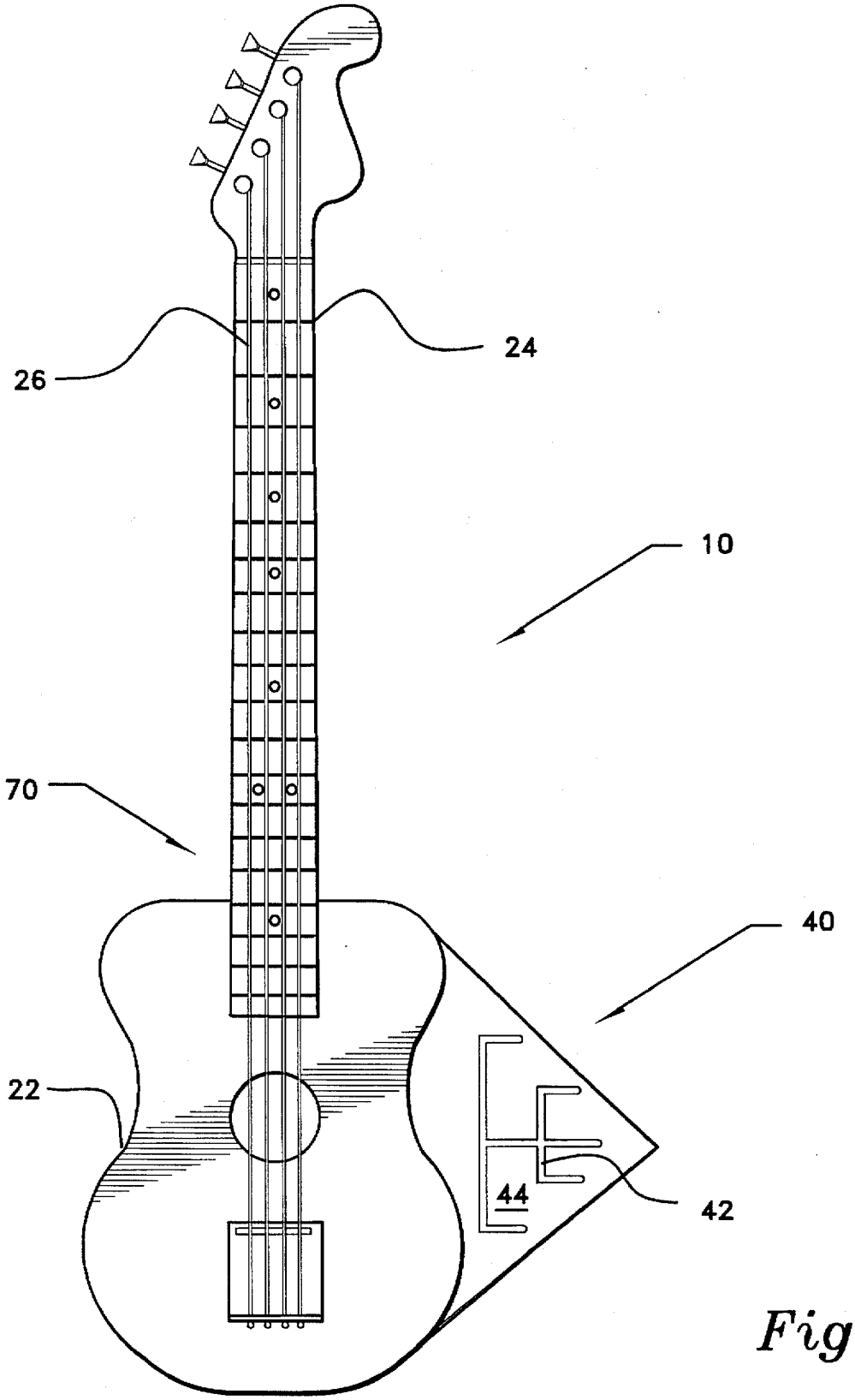
FIG. 5 is a front elevational view of an embodiment of the present invention showing an acoustic guitar and an extending portion with the keyboard removed to reveal the adjustment channels.

Referring to FIG. 4, the body 22 of the stringed instrument 20 has an extending portion 40 attached thereto. The extending portion 40 may be either integrated into the structure of the body 22 or it may be securely mounted to the body 22 using braces (not shown) or any other conventional mounting method. As a person skilled in the art will appreciate, certain mounting methods may not be suitable for use with acoustical guitars, due to the fact that the acoustical characteristics of the hollow body 22 may be compromised by those mounting methods. FIG. 5 shows the extending portion 40 integrated into the design of an acoustic guitar.

It is contemplated in the present invention, that the extending portion 40 may take on any number of shapes and sizes. One embodiment of the extending portion is shown in FIG. 4. Here the extending portion is generally triangular in shape and it has an upper surface 44 which is slightly recessed compared to the upper surface of the body 22, as can best be seen in FIG. 3. The recess of surface 44 allows the keys 32 of the keyboard 30 to be near the strings 26 of the stringed instrument 20 when a keyboard 30 of substantial thickness is used with the present invention. If a thinner keyboard 30 is used with the present invention, then surface 44 may not require as large a recess or may not require any recess.

Figure 2:
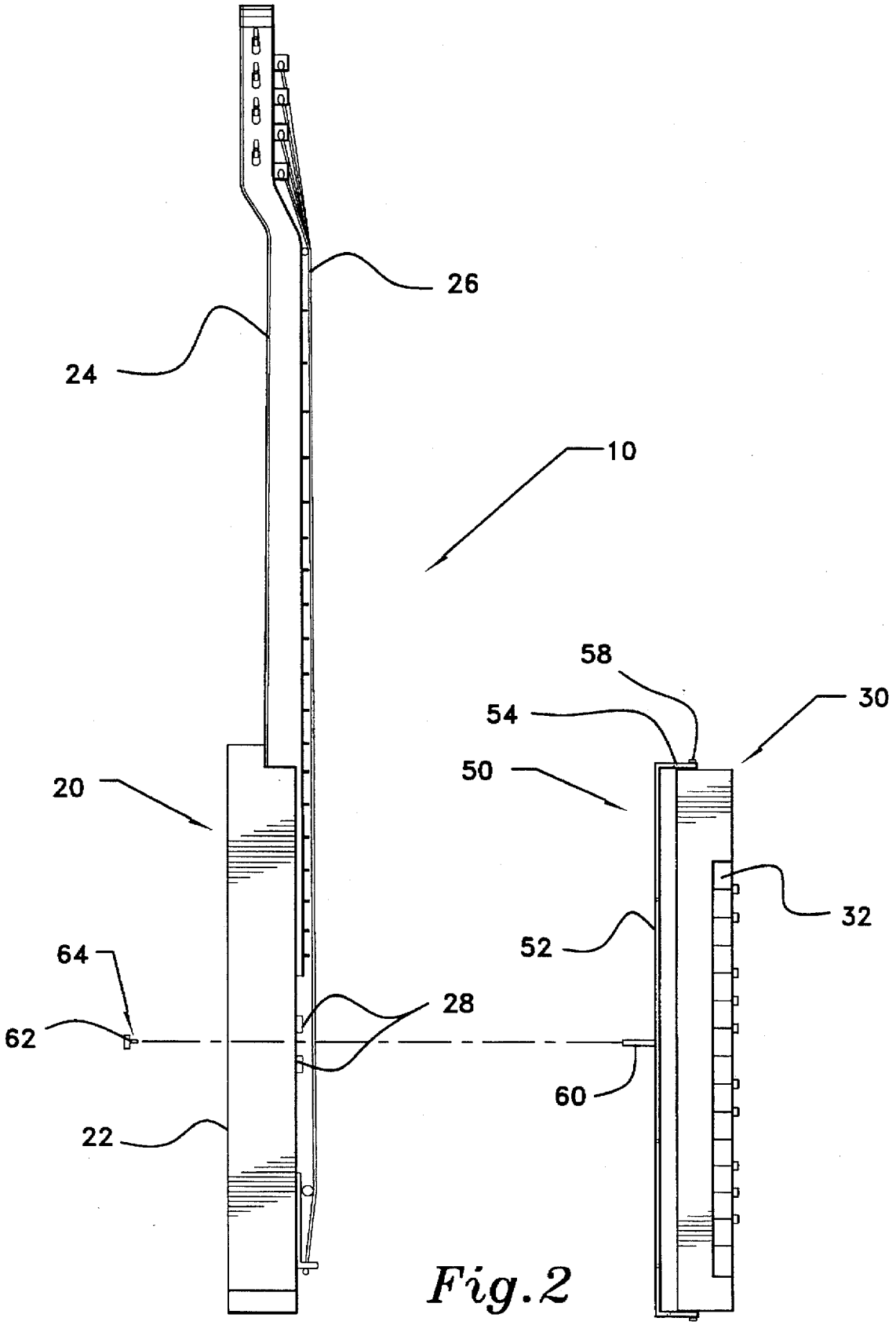
FIG. 2 is a side elevational exploded view of a stringed musical instrument with keyboard according to the present invention.

The preferred embodiment of the bracket 50 can best be seen in FIGS. 2 and 3. The preferred embodiment of the bracket 50 includes a generally flat elongated strip of metal which has a center section 52 and a pair of upwardly angled end portions 54. In the preferred embodiment the bracket 50 is approximately one inch wide and the end portions 54 are approximately two inches in length.

The end portions 54 have slots 56 therethrough. It should be noted that different shaped slots 56 may be used if so desired, such as zigzag shaped slots (not shown). The keyboard 30 is attached to the bracket 50 by placing a pair of knobs 58 with protruding threaded screws (not shown) through the slots 56 and into internally threaded sleeves (not shown) in both sides of the keyboard 30. Wing nuts may be used in place of the knobs 58 shown in FIGS. 2 and 3. The keyboard 30 is then positioned at the level and the tilt angle that the user feels most comfortable, and then the knobs 58 are tightened until the end portions 54 are pinched between the knobs 58 and the sides of the keyboard 30, thereby locking the keyboard 30 in position on the bracket 50. The height of the keyboard 30 is adjusted by sliding the keyboard 30 up and down slots 56, while the tilt angle is adjusted by rotating the keyboard 30 around the threaded screws of the knobs 58. It is contemplated that other similar adjustment devices may be used which achieve similar results.

The bracket 50 has an internally threaded sleeve 60 affixed to the center of the center section 52. The sleeve 60 protrudes outwardly from the bracket 50 in a direction substantially opposite that of the end portions 54. The sleeve 60 is sized so that it may fit within the channel 42, but it does not extend beyond the bottom surface of the extending portion 40. The bracket 50 is attached to the extending portion 40 by placing a knob 62 with a protruding threaded screw 64 through the channel 42 and into the internally threaded sleeve 60. A wing nut may be used in place of the knob 62 shown in FIGS. 2 and 3. The keyboard 30 is then positioned at the location in the channel 54 and the rotational angle that the user feels most comfortable, and then the knob 62 is tightened until the extending portion 40 is pinched between the knob 62 and the bracket 50, thereby locking the bracket 50 in position on the extending portion 40.

The location of the bracket 50, and therefore the keyboard 30, in the channel 54 may be adjusted by sliding the sleeve 60 along the channel 54 to the desired position. It is contemplated in the present invention that the shape of the extending portion 40 and the pattern of the channel 42 may be modified so that the present invention 10 can accommodate different keyboards 30. They may also be modified in order to allow greater flexibility in the positioning of the keyboard 30 in relation to the strings 26 of the stringed instrument 20. The rotational angle between the bracket 50, and therefore the keyboard 30, and the strings 26 of the stringed instrument 20 is adjusted by rotating the bracket 50 around the sleeve 60. It is contemplated that other similar adjustment devices may be used which achieve similar results.

FIG. 5 shows an embodiment of the present invention with the extending portion 40 integrated into the design of an acoustic guitar 70 or other similar stringed instrument. One issue that needs to be considered when using the present invention with an acoustic guitar 70, or other similar stringed instrument, is that the method of mounting the extending portion 40 to the body 22 of the guitar 70 should not substantially effect the acoustical characteristics of the guitar 70. Several methods that may be used include making the extending portion 40 an integrated extension of the upper or lower surface of the body 22, mounting the extending portion 40 in the same manner as the neck 24 is mounted to the body 22, gluing the extending portion 40 to the body 22, or other similar methods. It is contemplated in the present invention that the keyboard 30 may be capable, if desired, of extending over the upper surface of the body 22 in order to place the keys 32 of the keyboard 30 in close proximity to the strings 26 of the guitar 70. It should be noted that electric pick-ups (not shown) may be. attached to the body 22 for the purpose of amplification.

The present invention 10 allows the user to play up to nine notes at a time using a four string bass and up to eleven notes with a six string guitar.

It is to be further noted here that conventional electronics downstream of the pick-ups 28 are provided, viz., one or more synthesizers, MIDI's and computer(s) depending on the wishes of the musician/sound engineer, together, of course, with suitable amplifiers and speakers.

It is to be understood that the present invention is not limited to the embodiments described above, but encompasses any and all embodiments within the scope of the following claims.

I claim:

1. A stringed musical instrument with keyboard, comprising: a stringed musical instrument comprising:

a body;

a neck; and a plurality of strings extending across said neck and said body;

an extending portion attached to said body and extending outward from said strings;

a keyboard having a plurality of keys; and means for adjustably attaching said keyboard to said extending portion.

2. A stringed musical instrument with keyboard according to claim 1, wherein said body is hollow.

3. A stringed musical instrument with keyboard according to claim 1, wherein said body is solid.

4. A stringed musical instrument with keyboard according to claim 1, wherein said stringed musical instrument is an electric guitar.

5. A stringed musical instrument with keyboard according to claim 1, wherein said stringed musical instrument is a bass guitar.

6. A stringed musical instrument with keyboard according to claim 1, wherein said body includes electric pick-ups.

7. A stringed musical instrument with keyboard according to claim 1, wherein said stringed musical instrument is an acoustic guitar.

8. A stringed musical instrument with keyboard according to claim 7, said body having predetermined acoustical characteristics, said stringed musical instrument with keyboard further comprising means for attaching said extending portion to said body such that the acoustical characteristics of said body are not substantially effected by said attachment.

9. A stringed musical instrument with keyboard according to claim 8, wherein said body includes electric pick-ups.

10. A stringed musical instrument with keyboard according to claim 1, wherein said extending portion is recessed in relation to said body.

11. A stringed musical instrument with keyboard according to claim 1, wherein said means for adjustably attaching said keyboard to said extending portion comprises:

a bracket having means for slidably and pivotally mounting said bracket to said extending portion;

said bracket having means for slidably and pivotally mounting said keyboard to said bracket;

means for locking said bracket in a fixed position on said extending portion; and means for locking said keyboard in a fixed position on said bracket.

12. A stringed musical instrument with keyboard according to claim 11, wherein said means for slidably and pivotally mounting said bracket to said extending portion comprises:

a channel defined through said extending portion; and said bracket having a sleeve protruding therefrom into said channel, said sleeve being capable of rotating and sliding within said channel.

13. A stringed musical instrument with keyboard according to claim 12, wherein said channel has a first portion which extends in a direction substantially parallel to said strings and said channel has a second portion which extends in a direction substantially perpendicular to said strings.

14. A stringed musical instrument with keyboard according to claim 12, wherein said means for slidably and pivotally mounting said keyboard to said bracket comprises:

a pair of end portions on said bracket which protrude from said bracket in a direction opposite that of said sleeve, said end portions each having a slot therethrough; and a pair of rods connected to said keyboard which each extend through said slot, said rods being capable of rotating and sliding within said slots.

15. A stringed musical instrument with keyboard according to claim 14, wherein said means for locking said bracket in a fixed position on said extending portion comprises:

threaded means internally of said sleeve; and a grip having a threaded protrusion extending therefrom, said threaded protrusion extending through said extending portion and mating with said internal threads of said sleeve.

16. A stringed musical instrument with keyboard according to claim 15, wherein said means for locking said keyboard in a fixed position on said bracket comprises:

a pair of holes defined in said keyboard, said holes being internally threaded; and said pair of rods each having a first end and a second end, said first end of said rods having a grip attached thereto, said second end of said rods being threaded, said second ends of said rods extending through said slots and mating with said internal threads of said holes.

17. A stringed musical instrument with keyboard, comprising:

a stringed musical instrument comprising:

a hollow body;

a neck; and a plurality of strings extending across said neck and said body;

an extending portion attached to said body and extending outward from said strings; and a keyboard having a plurality of keys, said keyboard being attached to said extending portion.

18. A stringed musical instrument with keyboard according to claim 17, said body having predetermined acoustical characteristics, said stringed musical instrument with keyboard further comprising means for attaching said extending portion to said body such that the acoustical characteristics of said body are not substantially effected by said attachment.

19. A stringed musical instrument with keyboard according to claim 18, wherein said body includes electric pick-ups.

* * * * *